US005791180A

United States Patent [19]

Ha

[11] Patent Number: 5,791,180

[45] Date of Patent: Aug. 11, 1998

[54] DOOR LOCK DEVICE

[76] Inventor: Soo Hong Ha, 75-12 Shinlimbon-dong, Kwanak-gu, Seoul, Rep. of Korea

[21] Appl. No.: 769,365

[22] Filed: Dec. 19, 1996

[51] Int. Cl.[6] ..... E05B 35/08

[52] U.S. Cl. ..... 70/337; 70/120; 70/134

[58] Field of Search ..... 70/337–339, 113, 70/118, 120, 129, 134

[56] References Cited

U.S. PATENT DOCUMENTS

| | | | |
|---|---|---|---|
| 1,027,173 | 5/1912 | Bisesi | 70/338 |
| 1,057,884 | 4/1913 | Rose | 70/338 |
| 2,097,407 | 10/1937 | Spinello | 70/339 |
| 3,154,938 | 11/1964 | Cohen | 70/339 X |
| 3,367,700 | 2/1968 | Carnicero | 70/339 X |
| 3,595,358 | 7/1971 | Chase | 70/338 X |
| 3,768,285 | 10/1973 | Schwartz | 70/134 |
| 3,896,645 | 7/1975 | Nagy et al. | 70/149 |
| 4,067,212 | 1/1978 | Vorob | 70/120 X |
| 4,353,582 | 10/1982 | Eigemeier | 70/120 X |
| 4,534,191 | 8/1985 | Rogers et al. | 70/339 X |
| 4,803,902 | 2/1989 | Mauer | 70/339 |
| 5,573,287 | 11/1996 | Takimoto | 292/29 |
| 5,577,783 | 11/1996 | Kaminski | 292/268 |

FOREIGN PATENT DOCUMENTS

| | | | |
|---|---|---|---|
| 7900253 | 7/1980 | Netherlands | 70/339 |

*Primary Examiner*—Suzanne Dino

*Attorney, Agent, or Firm*—Michael D. Bednarek; Kilpatrick Stockton LLP

[57] ABSTRACT

A door lock device that includes a lock body having a plurality of latch bolts, a key holder cylinder having one cylindrical key plug and lock lever for each latch bolt. The components are fastened together by two long shaft bolts from a lever body side, so locking and a releasing are available only by operation of keys or levers equal in number to the number of cylindrical key plugs or only by identical keys.

4 Claims, 3 Drawing Sheets

DOOR LOCK DEVICE

BACKGROUND OF THE INVENTION

1. Field of the Invention

The present invention relates to a door lock device installed in an entrance way door for use in addition to a door knob lock to improve security of the door, and more particularly to a door lock device that improves crime prevention through greater security of the entrance way door, uses fewer parts that could fail and offers convenient installation in the door.

2. Discussion of Related Art

A conventional door lock device includes a single cylindrical key plug in a key holder cylinder, a single lock lever in a lever body and a single latch bolt in each lock body. As a result, locking or releasing the lock is performed with one key. In the installation process, the key holder cylinder is placed outside the door and the lock body and the lever body are placed inside the door. The key holder cylinder and lever body are each connected by a shaft to the latch bolt to thereby control the latch bolt, i.e., separate shafts are used. In such a door lock device, since there is only one plug, the time required for locking the latch bolt with the key or releasing the lock is short and also its method is easy, but this type of lock is also somewhat less effective for crime prevention and security. Also, since the key holder cylinder and the lever body are connected to the latch bolt by separate shafts, there is naturally a gap occurring in the connection of the two shafts. The gap creates some error or "slack" between movement of the lock lever and a key and the latch bolt in locking and releasing the lock because of the "slack" in the connection. As a result, the latch bolt is not moved easily, even with one operation of the key or the lock lever, and the lock might not be fully released or fully locked at the proper time. Therefore, if the key or the lock lever is operated repeatedly, as is usually the case, the possibility of failure in the lock device is increased. Furthermore, the key holder cylinder and the lever body are each respectively fastened by a bot, to the outside and inside of the door. As a result, installation of the door lock device is complicated and inconvenient.

SUMMARY OF THE INVENTION

The present invention is directed to a door lock device that substantially obviates one or more of the problems resulting from the limitations and disadvantages of the related art.

An object of the present invention is to provide the door lock device for a security reinforcement of an entrance way door, reduce the possibility of failure and improve installation convenience in a door.

It is another object to provide a door lock device that includes a key holder cylinder having a plurality of cylindrical key plugs, a lever body having a plurality of lock levers equal in number to the number of cylindrical key plugs, and a lock body having a common number of cylindrical key plugs, lock levers and latch bolts to improve crime prevention security by locking a door and opening a locked door only with operation of a plurality of keys or levers.

It is still another object to provide a door lock device in which respective cylindrical key plugs and lock levers are directly connected in pairs by a single shaft, that controls a corresponding latch bolt such that the latch bolt is operated without a failure regardless of whether the key and the lock lever is operated, so that the locking or the releasing can be performed precisely.

It is yet another object to provide a door lock device whose installation is easy by fastening the lever body, the lock body and the key holder cylinder with a pair of long shaft bolts extending inward from a lever side of the lock device so that disassembly from the outside (i.e., the key holder cylinder side) is impossible.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF PREFERRED EMBODIMENT

Reference will now be made in detail to the preferred embodiments of the present invention, examples of which are illustrated in the accompanying drawings.

Figure 1:
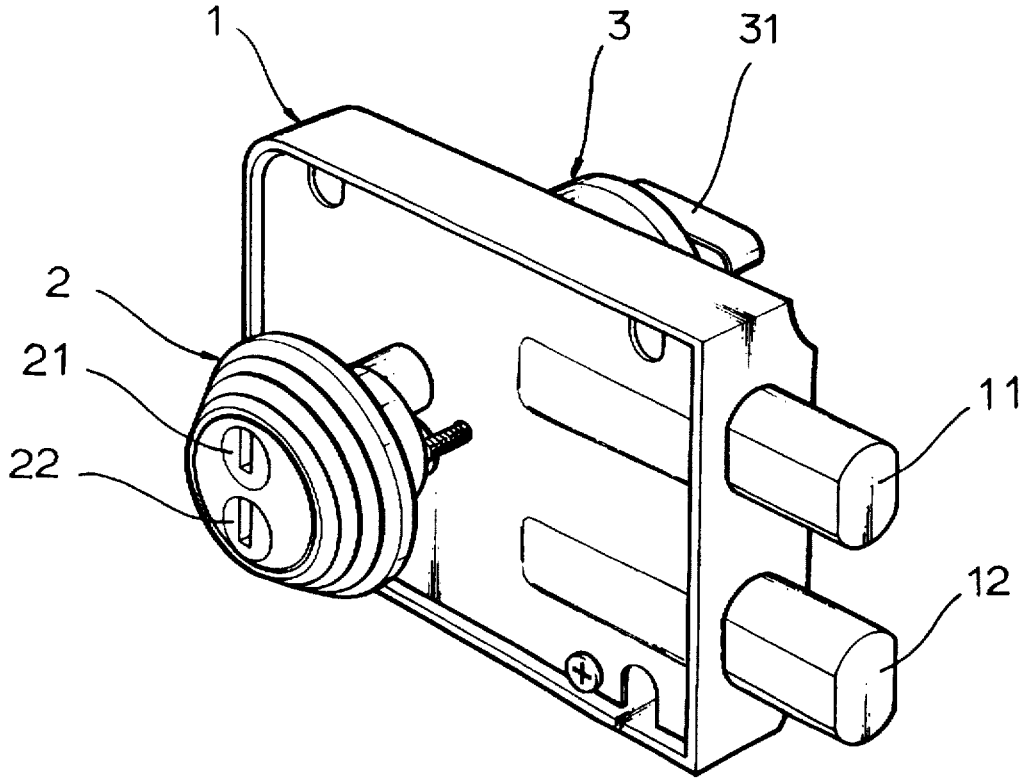
FIG. 1 is a perspective view of a door lock device according to the present invention.

FIG. 1, shows a lock body 1 having two latch bolts 11 and 12 installed in its inside. A key holder cylinder 2 having a plurality of cylindrical key plugs 21 and 22 equal in number as the number of latch bolts 11 and 12 (in this case, two) is provided. A lever body 3 having a plurality of lock levers 31 and 32 equal to the number of cylindrical key plugs 21 and 22 is also provided, but only one cylindrical key plug 3 is shown in FIG. 1.

Figure 2:
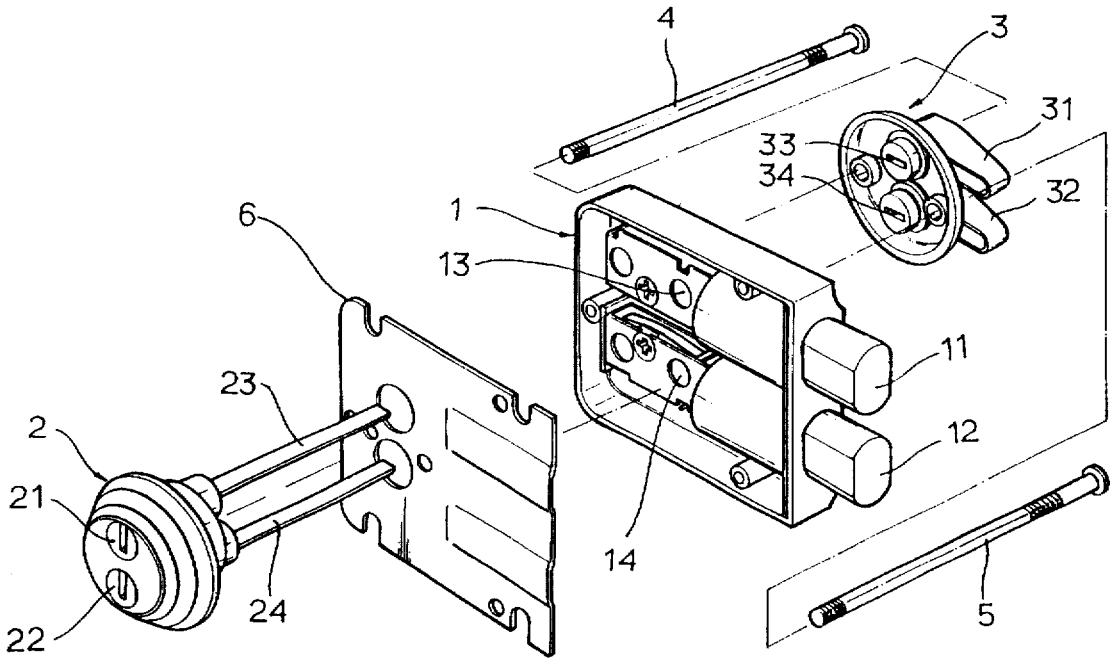
FIG. 2 is an exploded perspective view according to the present invention.

Referring to FIG. 2, in the body 1 a pair of the latch bolts 11 and 12 whose shape and structure are the same are installed inside the lock body and arranged vertically as an upper and lower latch bolt. On a supporter supporting an inner side end of a casing of the latch bolts 11 and 12, side holes 13 and 14 which key shafts 23 and 24 lead to an other side of the cylindrical key plugs 21 and 22 pierce, are pierced separately. These side holes 13 and 14 lead to shaft holes of the latch bolts 11 and 12.

Respective cylindrical key plugs 21 and 22 of the key holder cylinder 2 can be designed for locking and unlocking with one key or with a different key for each cylindrical key plug. On the other side, the respective cylindrical key plugs 21 and 22 independently have the key shafts 23 and 24 associated therewith for controlling the latch bolts 11 and 12 corresponding to each cylindrical key plug. The key shafts 23 and 24 are large in a bending stress, and are steel rods so that the latch bolts 21 and 22 can be controlled even with the lock levers 31 and 32, and namely are angle rods. The lock levers 31 and 32 of the lever body 3 are installed on the same axial shaft line as the cylindrical key plugs 21 and 22, i.e., the lock levers 31 and 32 are coaxial with the cylindrical key plugs, 21 and 22, respectively. It is well known that shaft holes 33 and 34 into which the respective key shafts 23 and 24 are inserted are formed on the shaft of the lock levers 31 and 32 and extend into the lever body 3.

Long shaft bolts 4 and 5 are provided to bind the body 1, the key holder cylinder 2 and the lever body 3 in one. The shaft bolts 4 and 5 comprise a set of two bolts that pierce the body 1 and the other side plate 6 from two bosses 35 and 36 formed in the lever body 3 and then are fastened to the other side of the key holder cylinder 2. For this purpose, bolt holes or fastening holes are provided on the body 1, the other side plate 6 and the other side of the key holder cylinder 2. The bolt holes or fastening holes are aligned with the bosses 35 and 36. The length of the bolts 4 and 5 naturally depends on the thickness of the door on which the locking device is installed.

Figure 3:
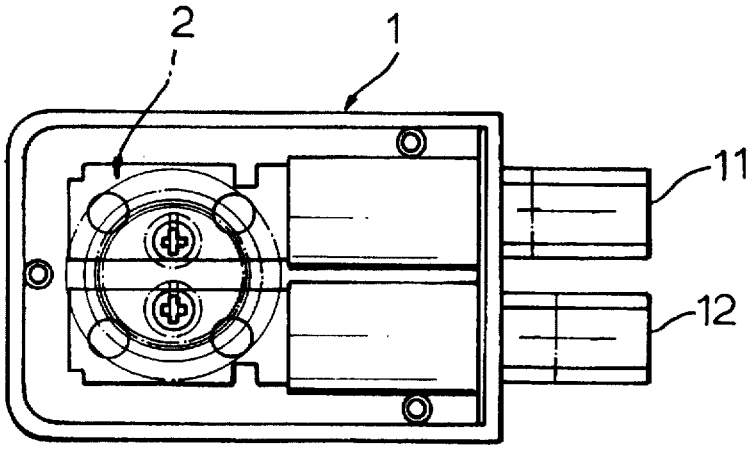
FIG. 3 is a rear view of a body; another side plate is omitted.
Figure 4:
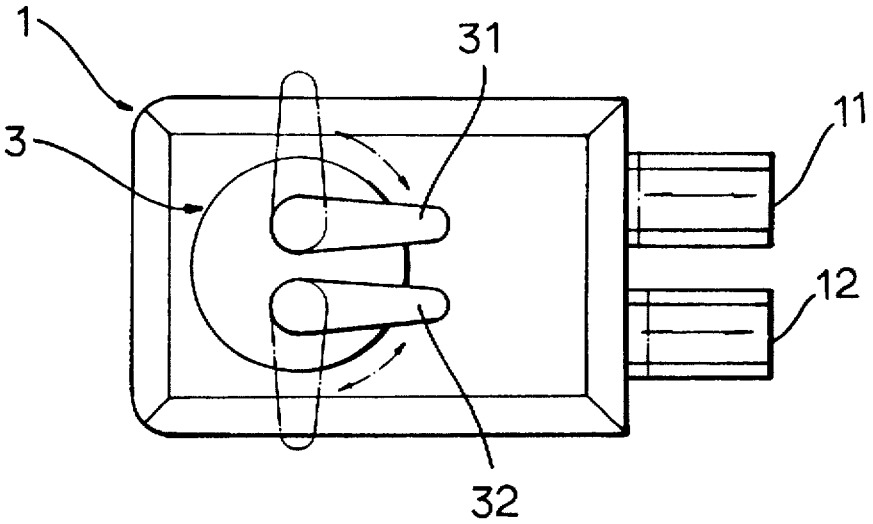
FIG. 4 is a front plan view shown at a lever body side.

FIGS. 3 and 4 show the lock device in an assembled state, (i.e., the body 1, the key holder cylinder 2 and the lever body 3). In FIG. 3, the key holder cylinder is shown in phantom and the other side plate is omitted. FIG. 4 is a front view shown at the lever body side. Herein, the cylindrical key plug 21 and the lock lever 31 and the latch bolt 11 operate as one set, and another cylindrical key plug 22 and the lock lever 32 and the latch bolt 12 operate as another set. FIG. 4, illustrates the locking and unlocking of the upper latch bolt 11 by moving the lever 31 between a horizontal and an upwards vertical position, and that the locking and unlocking of the lower latch bolt 12 by moving the lever 32 between the horizontal and a downwards vertical position. The action and effects of the locking device in these circumstances are as follows.

To lock the door from the outside (assuming the door is closed), one inserts the key into the respective cylindrical key plugs 21 and 22, then turns an upper key 90 degrees in an upper direction and a lower key 90 degrees in a lower direction. At this time, the key shafts 23 and 24 turn along the key turning direction so that the latch bolts 11 and 12 are moved to the latched position. Also, the lock levers 31 and 32 turn along the respective key shaft turning direction. After that, the key is returned to its original position and is taken out of the cylindrical key plugs 21 and 22, and at this time the latch bolts 11 and 12 and the lock levers 31 and 32 do not return to the state previous to the locked state since the key shafts 23 and 24 stayed under the lock state do not return to the original position.

To lock the door from the inside (again, assuming the door is closed), one need only turn the upper lock lever 31 90 degrees upwards and the lower lock lever 32 90 degrees downwards. At this time, the key shafts 23 and 24 turn along the lock levers 31 and 32 turning direction then the latch bolts 11 and 12 are moved to the latched position, but the cylindrical key plugs 21 and 22 are not operated. However, since there is not any difference from the state locked with the key, an outsider cannot open the locked door without using the key.

To open the door from outside when the latch bolts 11 and 12 are locked, the key is inserted into the respective cylindrical key plugs 21 and 22, the upper key turns 90 degrees upwards then returns to the original position and the lower key turns 90 degrees downwards then returns to the original position. After that, the latch bolts 11 and 12 retreat and the lock state can be released. To open the door from the inside when the latch bolts 11 and 12 are locked, the upper lock lever 31 turns 90 degrees from the vertical state to the horizontal so as to be placed to the original position, and the lower lock lever 32 turns 90 degrees upwards so as to be placed to the original position, and after only that, all the latch bolts 11 and 12 retreat and the lock state can be released.

As above-mentioned, when the upper and lower latch bolts 11 and 12 are all locked, even if only one latch bolt 11 and 12 is released from the lock state, the door is not opened since the remaining latch bolt 12 or 11 is still in the locked state. When the latch bolts 11 and 12 are all released from the lock state, in case only one latch bolt 11 or 12 is locked, its lock state is weak. But if the plurality of latch bolts 11 and 12 are all locked, the locked state of the door provides an increased sense of crime prevention security.

As mentioned before, the present invention is constructed including the key holder cylinder having the plurality of cylindrical key plugs, the lever body having the lock levers of the same number as the cylindrical key plugs, an the body having the cylindrical key plugs, the lock levers and the latch bolts of the same number, and without the key operation for every cylindrical key plug or the operation of all lock levers of the lever body, the locking and the releasing of the door is impossible, therefore the invention provides crime prevention security against persons with impure intentions.

Since the door lock device of the present invention, the respective cylindrical key plugs and lock levers are directly connected to one another by the single key shaft, and thereby their corresponding latch bolts are controlled, and the latch bolts operate the same and without a failure regardless of whether the keys or the lock levers are operated. In this way the locking or the releasing is precisely performed, which is convenient.

Moreover, the door lock device of the present invention, the lever body and the body and the key holder cylinder are fastened by an insertion of a pair of long shaft bolts from the lever body side. This provides simple assembly and installation and security because disassembly of the key holder cylinder from the outside is impossible.

It will be apparent to those skilled in the art that various modifications and variations can be made in the door lock device of the present invention without departing from the spirit or scope of the invention. Thus, it is intended that the present invention cover the modifications and variations of this invention provided they come within the scope of the appended claims and their equivalents.

What is claimed is:

1. A door lock device for providing separate control of a plurality of latch bolts in a single key holder cylinder, the door lock device comprising:

a lock body having plurality of latch bolts;

a single key holder cylinder having one cylindrical key plug for each of the plurality of latch bolts; and a plurality of lock levers, wherein the number of lock levers is at least equal to the number of latch bolts; and two long shaft bolts fastening the lock levers, the lock body and the key holder cylinder together.

2. The door lock device as claimed in claim 1, further comprising a plurality of one piece key shafts, each key shaft connecting one of the cylindrical key plugs to a lock lever.

3. A door lock device for providing separate control of a plurality of latch bolts in a single key holder cylinder, the door lock device comprising:

a door lock body;

a plurality of latch bolts slidably mounted within the door lock body;

a single key holder cylinder having a plurality of cylindrical key plugs provided therein, each of the cylindrical key plugs having a key hole that is adapted to receive a key and each cylindrical key plug being turnable on an axis upon insertion of a key, but locked when a key is not inserted in the key hole;

a plurality of key shafts, each key shaft connected to one of the latch bolts and having first and second ends, a first end being connected to one of the cylindrical key plugs such that turning of the cylindrical key plugs translates into movement of the latch bolt;

a plurality of lock levers, each of the lock levers being aligned with one of the key plugs and being turnable upon an axis that is substantially coaxial with an axis of turning of one of the cylindrical key plugs and each of the lock levers being connected to the second end of one of the key shafts such that the operation of each latch bolt is controlled by one of the plurality of key shafts that is connected to a cylindrical key plug at the first end and a lock lever at the second end.

4. A door lock device comprising:

a door lock body;

a plurality of latch bolts slidable mounted within the door lock body;

a single key holder cylinder having a plurality of cylindrical key plugs provided therein, each of the cylindrical key plugs having a key hole that is adapted to receive a key and each cylindrical key plug being turnable on an axis upon insertion of a key;

a plurality of key shafts, each key shaft connected to one of the latch bolts and having first and second ends, a first end being connected to one of the cylindrical key plugs such that turning of the cylindrical key plugs translates into movement of the latch bolt;

a plurality of lock levers, each of the lock levers being aligned with one of the key plugs and being turnable upon an axis that is substantially coaxial with an axis of turning of one of the cylindrical key plugs and each of the lock levers being connected to the second and of one of the key shafts such that the operation of each latch bolt is controlled by one of the plurality of key shafts that is connected to a cylindrical key plug at the first end and a lock lever at the second end; and means for fastening the lock levers, the lock body and the key holder cylinder together.

* * * * *